US010543689B2

(12) United States Patent
Hasebe et al.

(10) Patent No.: US 10,543,689 B2
(45) Date of Patent: Jan. 28, 2020

(54) LIQUID DISCHARGE APPARATUS

(71) Applicants: Daisuke Hasebe, Kanagawa (JP); Tatsuroh Watanabe, Kanagawa (JP); Yukihiro Asano, Kanagawa (JP); Kenta Takahashi, Kanagawa (JP)

(72) Inventors: Daisuke Hasebe, Kanagawa (JP); Tatsuroh Watanabe, Kanagawa (JP); Yukihiro Asano, Kanagawa (JP); Kenta Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/104,378

(22) Filed: Aug. 17, 2018

(65) Prior Publication Data

US 2019/0184709 A1 Jun. 20, 2019

(30) Foreign Application Priority Data

Dec. 18, 2017 (JP) ..... 2017-242046
Jun. 21, 2018 (JP) ..... 2018-118078

(51) Int. Cl.
*B41J 2/165* (2006.01)

(52) U.S. Cl.
CPC ..... *B41J 2/16535* (2013.01); *B41J 2/16544* (2013.01); *B41J 2002/1655* (2013.01)

(58) Field of Classification Search
CPC ..... B41J 2/16535; B41J 2/16544; B41J 2002/1655
See application file for complete search history.

(56) References Cited

U.S. PATENT DOCUMENTS 4,369,456 A 1/1983 Cruz-Uribe et al.
2011/0080448 A1 4/2011 Hayashi

FOREIGN PATENT DOCUMENTS

| | | | | |
|---|---|---|---|---|
| JP | 60-098478 | | 6/1985 | |
| JP | 2003-118135 | | 4/2003 | |
| JP | 2003-127436 | | 5/2003 | |
| JP | 2008-137266 | * | 6/2008 | ..... B41J 2/165 |
| JP | 2008-137266 A | | 6/2008 | |
| JP | 2010-025998 | | 2/2010 | |
| JP | 2013-173244 | | 9/2013 | |

OTHER PUBLICATIONS

Extended European Search Report dated Mar. 6, 2019 in the corresponding European Application No. 18186598.1 7 pages.

* cited by examiner

*Primary Examiner* — Geoffrey S Mruk
(74) *Attorney, Agent, or Firm* — Oblon, McClelland, Maier & Neustadt, L.L.P.

(57) ABSTRACT

A roll unit includes a feeding roller to which a belt-shaped member is wound, and a winding roller to which the belt-shaped member fed from the feeding roll is wound. One of the feeding roller and the winding roller is relatively movable to the other of the feeding roller and the winding roller.

15 Claims, 16 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-242046, filed on Dec. 18, 2017, and Japanese Patent Application No. 2018-118078, filed on Jun. 21, 2018, in the Japan Patent Office, the entire disclosure of each of which is hereby incorporated by reference herein.

BACKGROUND

Technical Field

Aspects of the present disclosure relate to a roll unit, a roll device, a head maintenance device, and a liquid discharging apparatus.

Related Art

An apparatus using a liquid discharge head that discharges a liquid from nozzles includes a maintenance and recovery mechanism (maintenance device) to maintain and recover a state of the nozzles. The maintenance device includes a cap for capping a surface of the nozzles and a wiper for wiping and cleaning the surface of the nozzles. In particular, a maintenance device is known that uses a web as a wiper for wiping the surface of the nozzles.

SUMMARY

In an aspect of this disclosure, a novel roll unit includes a feeding roller to which a belt-shaped member is wound, and a winding roller to which the belt-shaped member fed from the feeding roll is wound. One of the feeding roller and the winding roller is relatively movable to the other of the feeding roller and the winding roller.

In another aspect of this disclosure, a novel roll device includes the roll unit as described above and a movable platform detachably mounting the roll unit to move the roll unit.

In still another aspect of this disclosure, a novel head maintenance device to maintain a liquid discharge head to discharge a liquid from nozzles includes the roll device as described above to wipe a surface of the liquid discharge head on which nozzles are formed with the wiping member.

In still another aspect of this disclosure, a novel liquid discharge apparatus includes a liquid discharge head to discharge a liquid from nozzles and the head maintenance device as described above.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
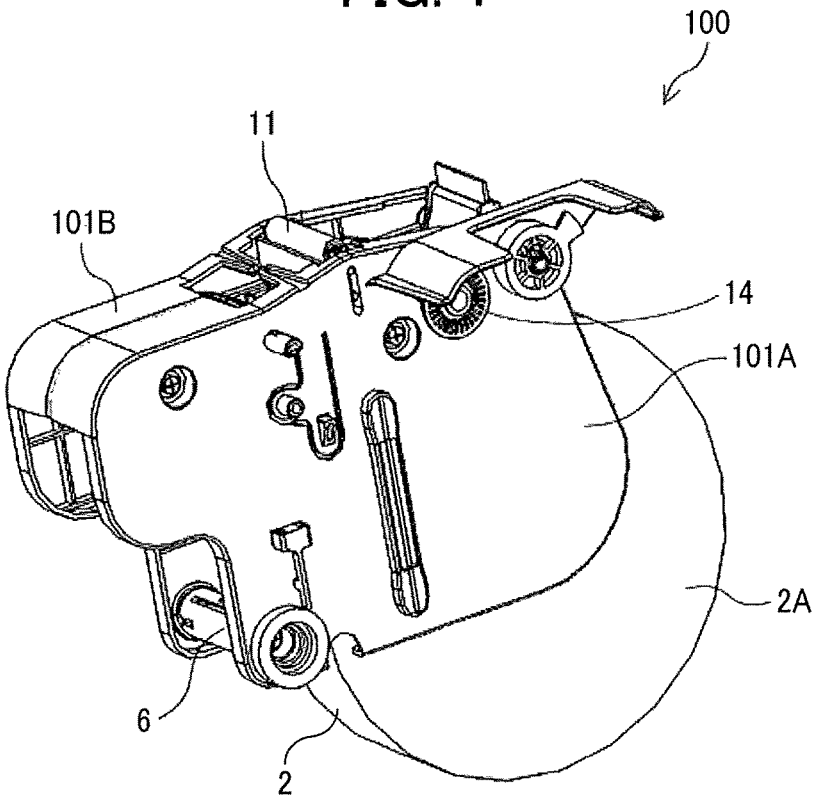
FIG. 1 is an external perspective view of a wiping cartridge as a roll unit according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views.

Figure 2:
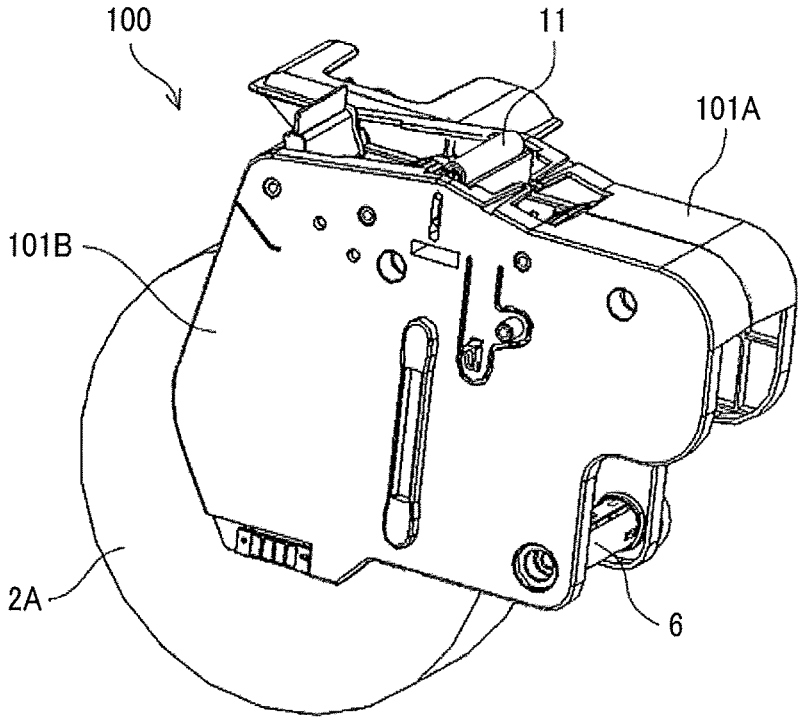
FIG. 2 is an external perspective view of the wiping cartridge as viewed from the side opposite to FIG. 1.
Figure 3:
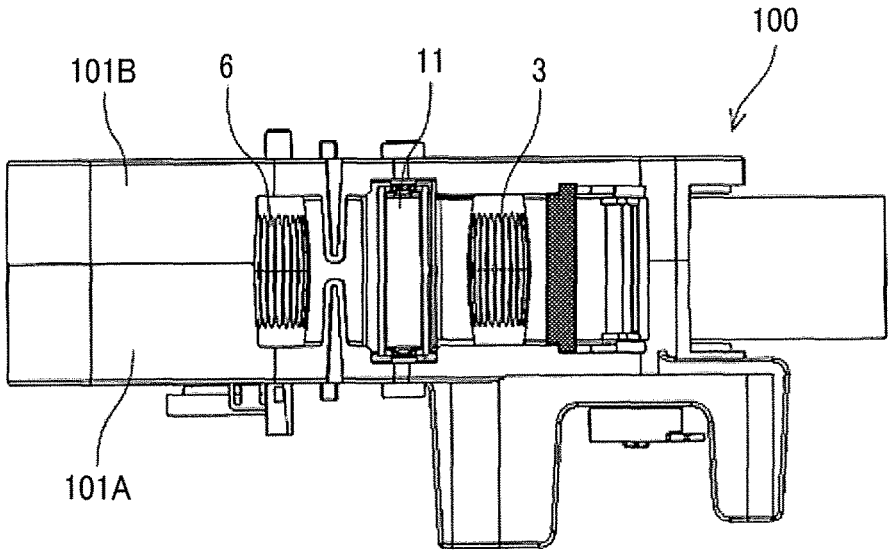
FIG. 3 is a side explanatory view of the wiping cartridge.
Figure 4:
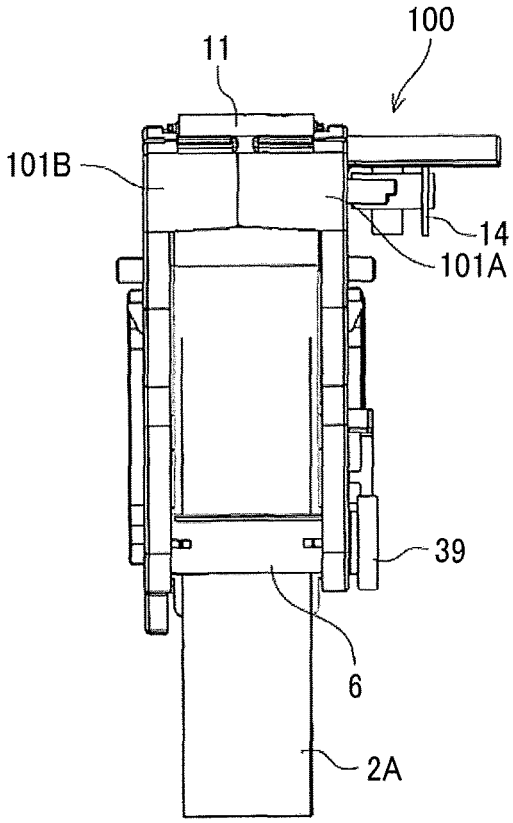
FIG. 4 is a plan explanatory view of the wiping cartridge.
Figure 5:
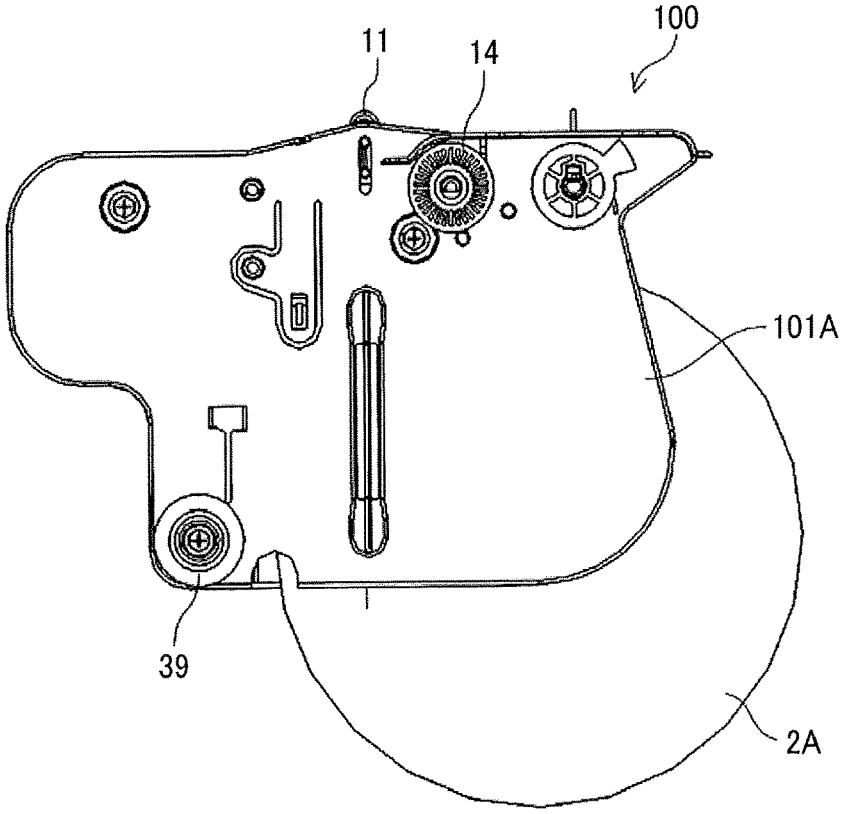
FIG. 5 is a front view of the wiping cartridge.
Figure 6:
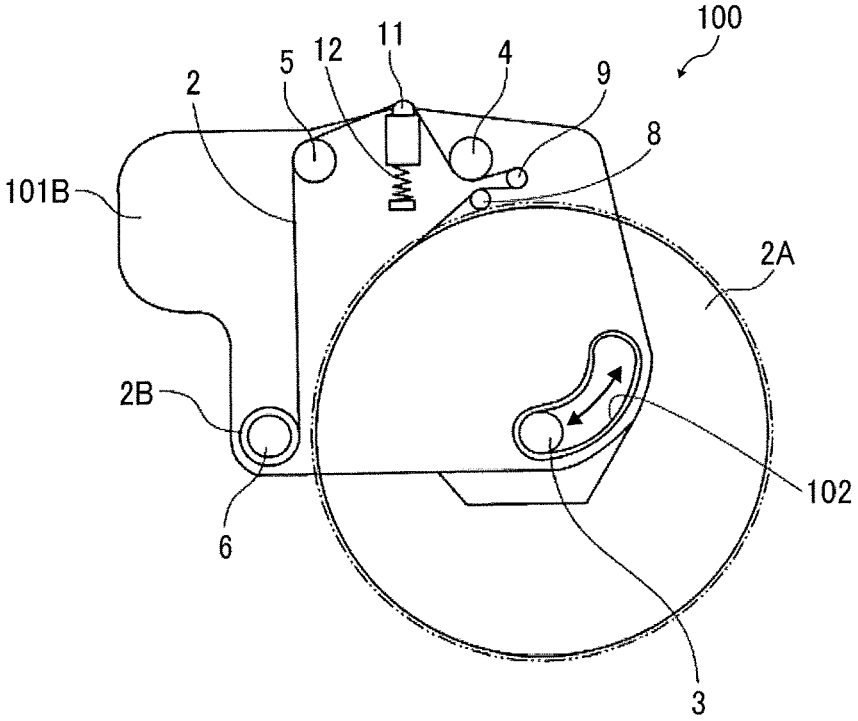
FIG. 6 is an internal side view of the wiping cartridge.

A first embodiment of the present disclosure is described with reference to FIGS. 1 through 6. FIG. 1 is a perspective view of a wiper cartridge as a roll unit according to a present embodiment. FIG. 2 is a perspective view of the wiper cartridge viewed from a direction opposite a direction of view in FIG. 1. FIG. 3 is a top view of the wiper cartridge according to the first embodiment. FIG. 4 is a front view of the wiper cartridge according to the first embodiment. FIG. 5 is a side view of the wiper cartridge according to the first embodiment. FIG. 6 is an internal side view of the wiper cartridge according to the first embodiment.

The wiping cartridge 100 includes a feeding roller 3 and a winding roller 6. The feeding roller 3 is a first axial core of a feeding roll 2A around which a sheet-shaped web 2 as a belt-shaped member is wound in a roll form. The winding roller 6 is a second axial core of a winding roll 2B that winds the web 2 fed out from the feeding roll 2A. In the initial state, the web 2 is not wound around the winding roller 6. However, for clarity of explanation, the winding roll 2B is formed in FIG. 6. Further, a state of the maximum outer diameter of the feeding roll 2A is illustrated by a two-dot chain line.

Preferably, the web 2 is made of an absorbent sheet-like material and resistant to at least the liquid to be used. Further, the web 2 is preferably made of material that does not generate fuzz or dust. Specific examples of such materials include, but are not limited to, non-woven fabric, cloth, film, and paper.

The web 2 is fed from the feeding roll 2A of the feeding roller 3 and wound by the winding roller 6 as the winding roll 2B via the guide rollers 8 and 9 and the conveyance rollers 4 and 5. A feeding side of the feeding roll 2A opposes the winding side of the winding roll 2B.

The feeding roller 3, the winding roller 6, the guide rollers 8 and 9, and the conveyance rollers 4 and 5 are rotatably held by a cartridge case 101 (101A and 101B) of the wiping cartridge 100. The cartridge case 101 is dividable into two parts.

The feeding roller 3, which is one of the axial core of the feeding roller 3 and the winding roller 6, is movably held in a guide groove 102 formed in the cartridge case 101. The feeding roller 3 is disposed to be relatively movable with respect to the winding roller 6, which is another of the axial core of the feeding roller 3 and the winding roller 6.

The guide groove 102 is formed in a curved shape in which the feeding roller 3 as one of the axial member is movable away from the winding roller 6 as another of the axial core in an obliquely upward direction as indicated by arrow in FIG. 6.

As a result, the feeding roller 3 initially moves to a lower end position of the guide groove 102 by its own weight of the feeding roll 2A at which a distance between the feeding roller 3 and the winding roller 6 becomes the shortest.

A pressing member 11 for pressing the web 2 against an object to be wiped is disposed between the two conveyance rollers 4 and 5. The pressing member 11 presses the web 2 against the object to be wiped with a predetermined pressing force by the spring 12 when the web 2 is to be contact with the object to be wiped.

An encoding wheel 14 is attached to the conveyance roller 4.

Figure 7:
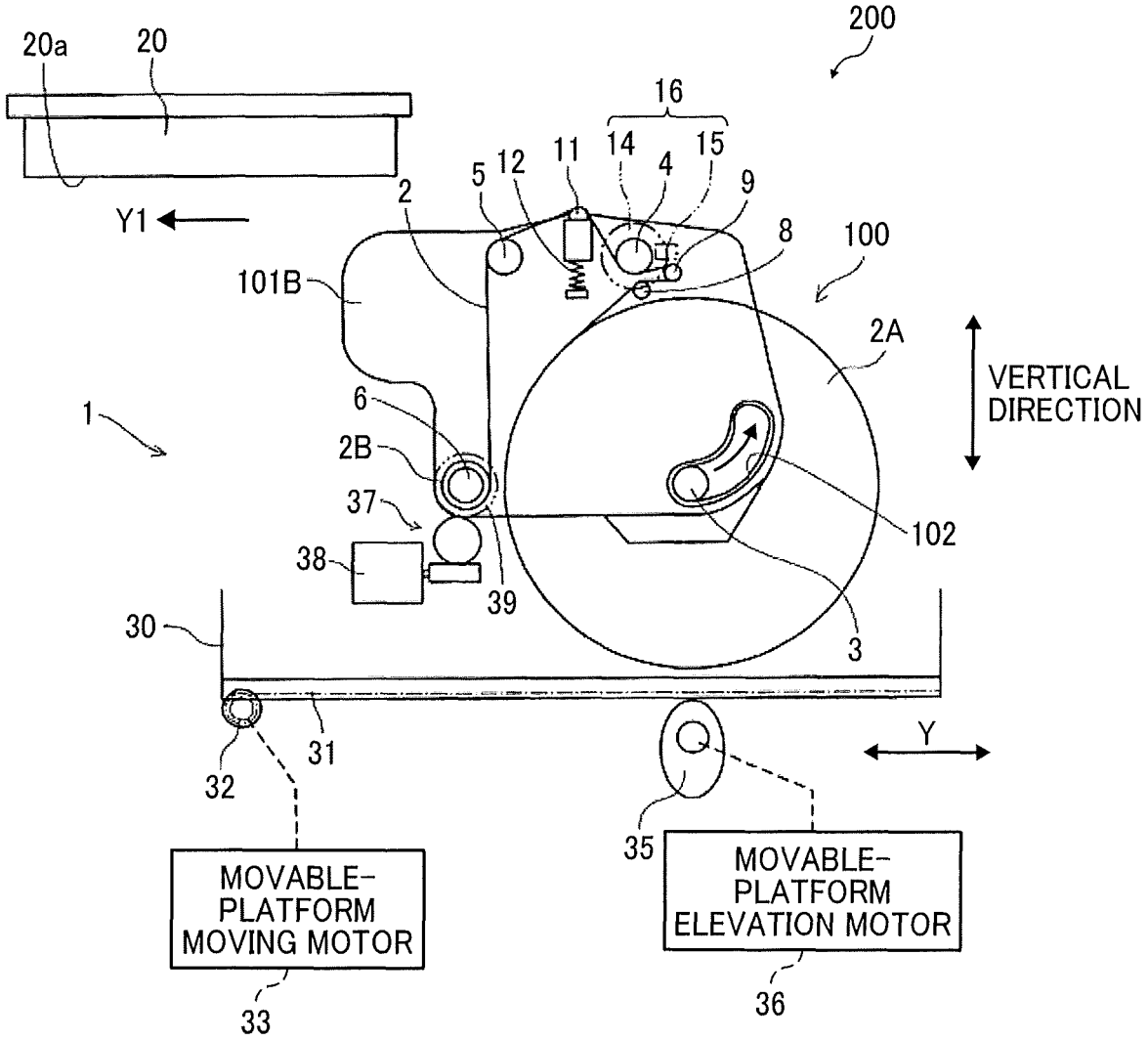
FIG. 7 is a side view of a wiping device as a roll device according to the present disclosure.

Next, a roll device as a wiping device according to the present disclosure is described with reference to FIG. 7. FIG. 7 is a side view of the wiping device including the wiping cartridge.

The wiping device 1 wipes a nozzle surface 20*a* of a liquid discharge head 20 (hereinafter also referred to as "head") of a liquid discharge apparatus 200.

The wiping cartridge 100 as a roll unit (wiping unit in this case) is detachably mounted on the movable platform 30.

The movable platform 30 includes a transmission mechanism 37 and a winding motor 38. The transmission mechanism 37 engages a gear 39 provided on the winding roller 6 when the wiping cartridge 100 is mounted on the movable platform 30. The winding motor 38 rotates the winding roller 6 via the transmission mechanism 37.

Further, the movable platform 30 includes an encoder sensor 15 that includes a transmissive photosensor for detecting a pattern formed on the encoding wheel 14 of the wiping cartridge 100. The encoding wheel 14 and the encoder sensor 15 constitute an encoder 16 for detecting a moving distance (feed amount) of the web 2.

Figure 23:
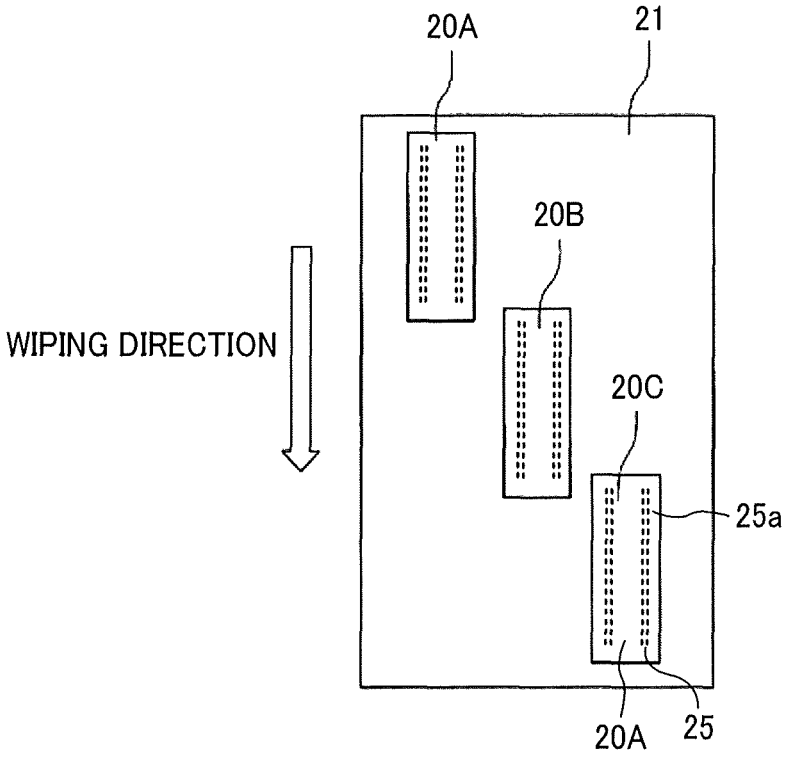
FIG. 23 is a plan view of an arrangement of heads in a carriage of a liquid discharge apparatus.

The movable platform 30 is reciprocally movable in a nozzle array direction of the heads 20 indicated by arrow Y in FIG. 7 that is a direction along a nozzle array 25 as illustrated in FIG. 23. The nozzle array 25 includes a plurality of nozzles 25*a* from which the liquid is discharged. The movable platform 30 moves in a wiping direction Y1 (see FIG. 7) by a moving mechanism including a rack 31, a pinion 32, and a movable-platform moving motor 33 for rotating the pinion 32. The wiping direction Y1 is along the nozzle array direction Y.

Further, the movable platform 30 is movable in a direction in which the web 2 advances toward and retracts from the nozzle surface 20*a*, in this case, in a vertical (elevational) direction. The movable platform 30 moves vertically by an elevation mechanism including a cam 35 and an elevation motor 36 that rotates the cam 35.

Next, a wiping operation of the wiping device 1 is described below.

When wiping the nozzle surface 20*a* of the head 20 with the wiping device 1, the movable platform 30 moves upward, and the web 2 is pressed against one end portion, which is the start of wiping of the nozzle surface 20*a* of the head 20, with a predetermined pressing force.

Then, the web 2 wipes and absorbs a liquid (referred to as waste liquid) remaining on the nozzle surface 20*a* to remove the waste liquid from the nozzle surface 20*a* by a movement of the movable platform 30 in the wiping direction Y1.

Then, the wiping device 1 rotates the winding roller 6 to wind the web 2 around the winding roll 2B before a next wiping operation and brings an unused portion of the web 2 into contact with the nozzle surface 20*a* in the next wiping operation. The wiping device 1 may wipe the nozzle surface 20*a* with the web 2 while rotating the winding roller 6 and winding the web 2 on the winding roll 2B. That is, the wiping device 1 may wipe the nozzle surface 20*a* with the web 2 while feeding the web 2 from the feeding roller 3 to the winding roller 6.

Figure 8A:
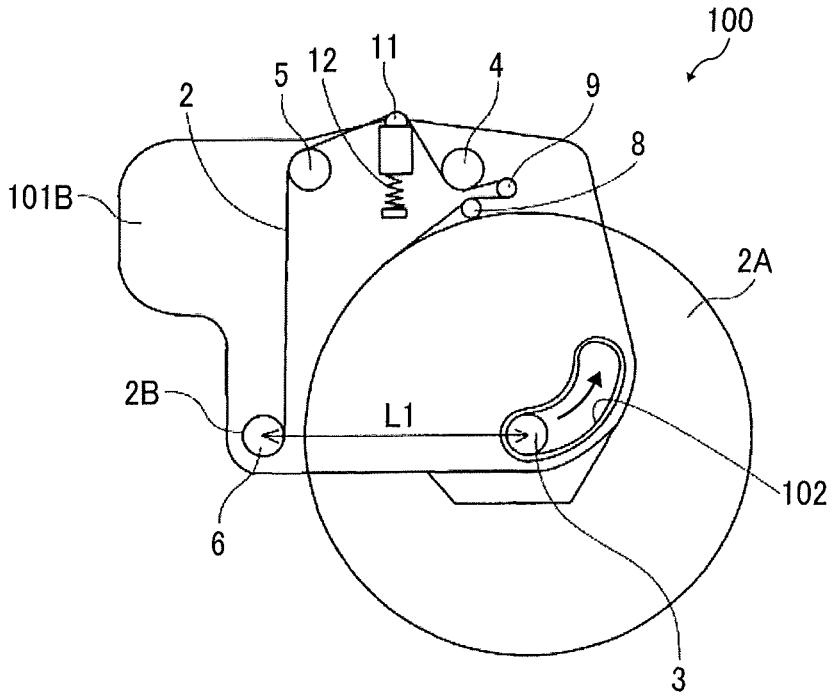
FIGS. 8A and 8B are side views for explaining transition states of a feeding roll and a winding roll accompanied with a wiping operation.
Figure 8B:
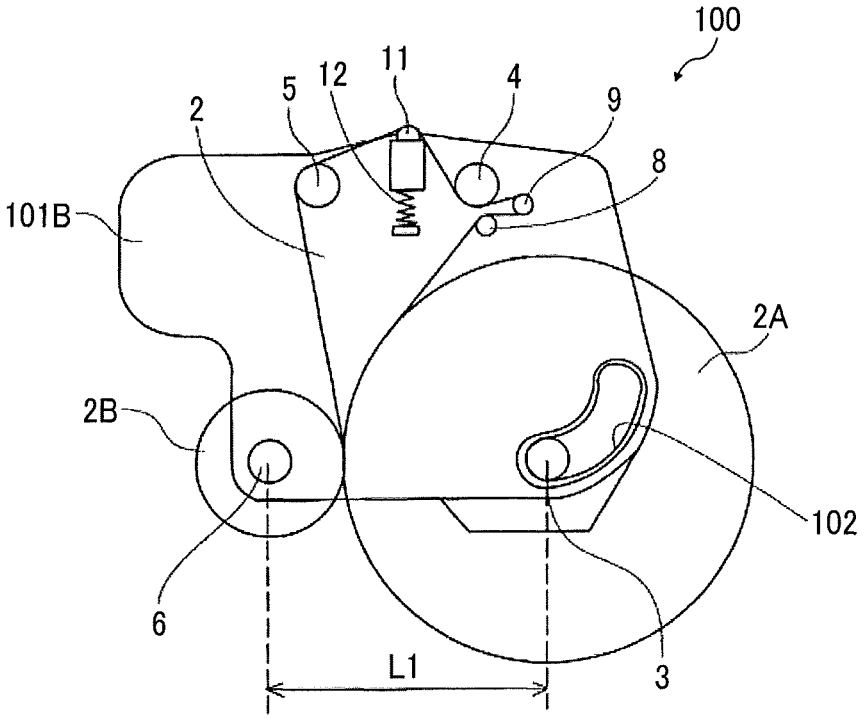

Next, a transitional state of the feeding roll 2A and the winding roll 2B accompanying the wiping operation is described with reference to FIGS. 8 to 10. FIGS. 8A and 8B through 10 are side views of the wiping device 1 illustrating the wiping operation.

First, as illustrated in FIG. 8A, in an initial state, an outer diameter of the feeding roll 2A is large and an outer diameter of the winding roll 2B is small (or the web 2 is not wound around the winding roll 2B). Then, the feeding roller 3 moves to a lower end position of the guide groove 102 due to a weight of the feeding roll 2A. The feeding roller 3 is disposed at a position closest to the winding roller 6 in the initial state.

A distance between an axial center of the feeding roller 3 and an axial center of the winding roller 6 in this initial state becomes a shortest axial-center distance L1.

By repeating the wiping operation from this initial state, the web 2 is fed from the feeding roll 2A and wound onto the winding roll 2B. Thus, the outer diameter of the feeding roll 2A decreases, and the outer diameter of the winding roll 2B increases.

As the winding of the web 2 on the winding roll 2B progresses, an outer periphery of the winding roll 2B comes into contact with an outer periphery of the feeding roll 2A as illustrated in FIG. 8B, for example. This is because the feeding roller 3 and the winding roller 6 are arranged such that the shortest axial-center distance L1 becomes shorter than an axial-center distance L3 (L1<L3). The axial-center distance L3 is a distance when the outer diameter of the feeding roll 2A is substantially equal to the outer diameter of the winding roll 2B as described below with reference to FIG. 9B.

Figure 9A:
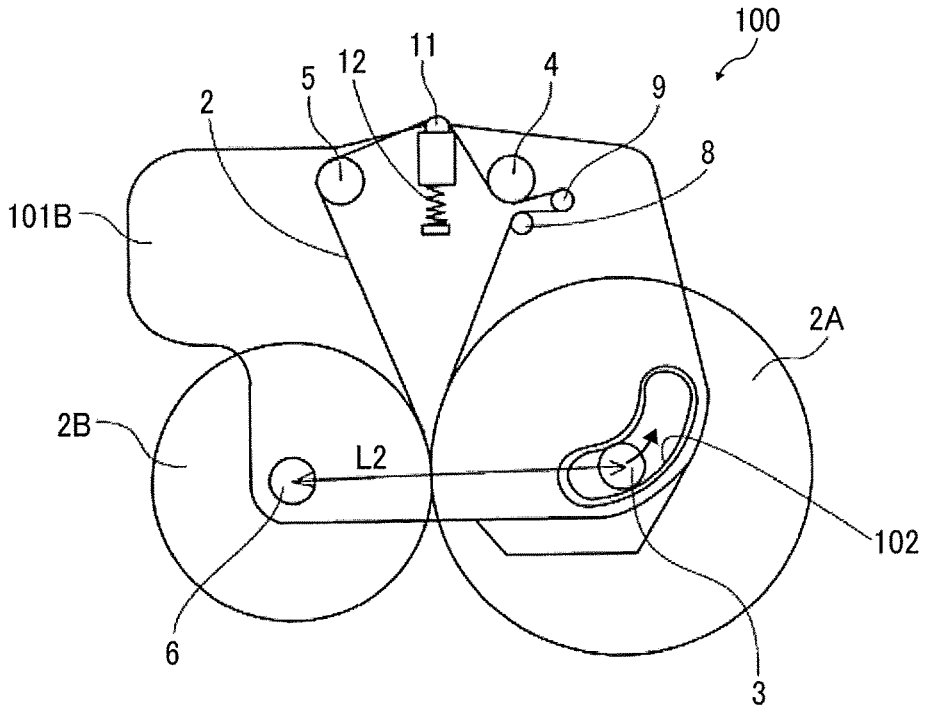
FIGS. 9A and 9B are side views of states following FIGS. 8A and 8B.

Further, as illustrated in FIG. 9A, as the outer diameter of the winding roll 2B increases, the feeding roll 2A is pushed by the winding roll 2B. As a result, the feeding roller 3 moves in a direction indicated by the arrow in FIGS. 9A and 9B along the guide groove 102 in an obliquely upward direction while being separated from the winding roller 6. At this time, an axial-center distance L2 between the feeding roller 3 and the winding roller 6 becomes longer than the shortest axial-center distance L1 (L2>L1).

Figure 9B:
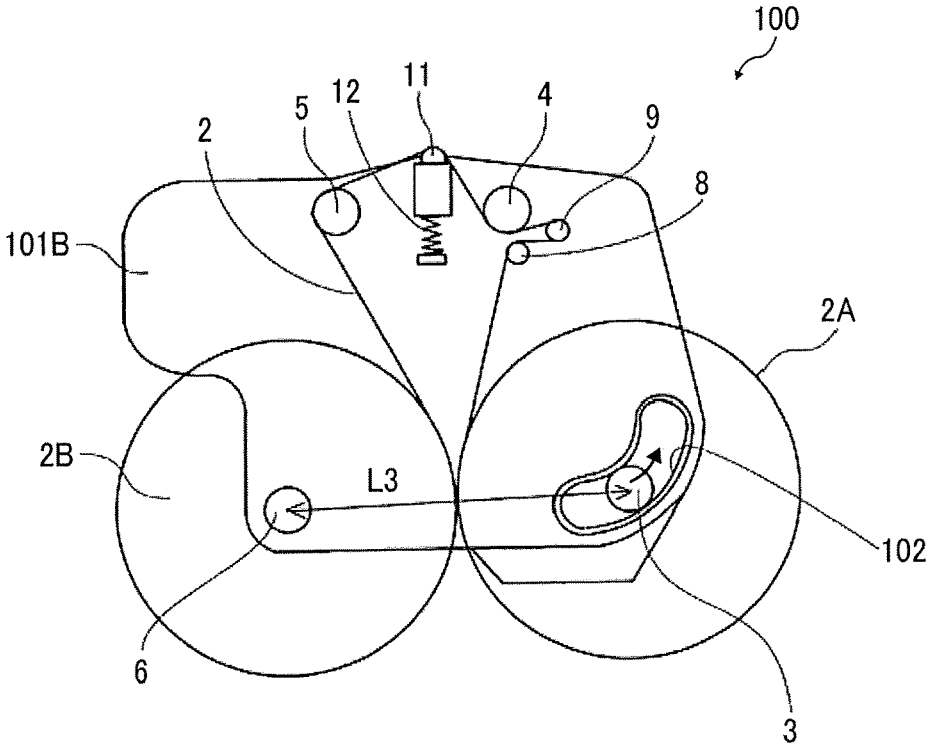
Figure 10:
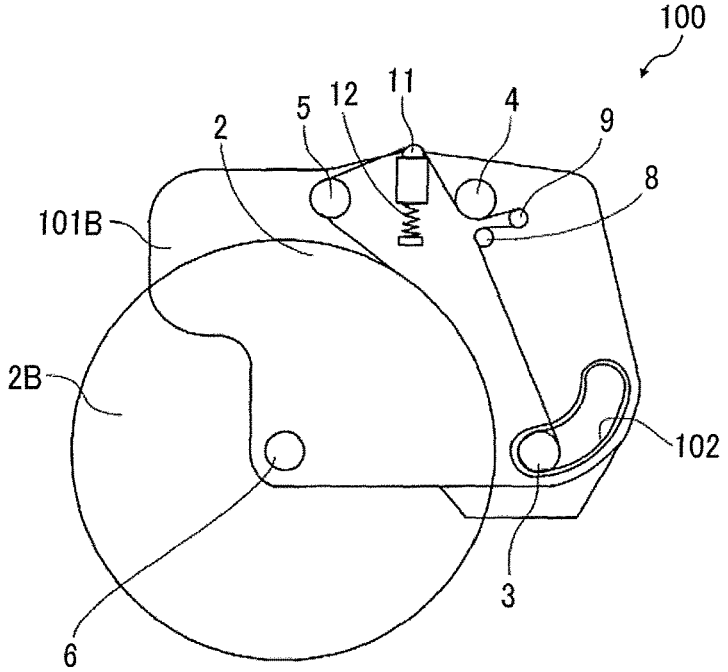
FIG. 10 is a side view of a state following FIG. 9.

Then, as illustrated in FIG. 9B, the outer diameter of the winding roll 2B is substantially equal to the outer diameter of the feeding roll 2A. At this time, the axial center distance between the feeding roller 3 and the winding roller 6 becomes a longest axial-center distance L3 (L3>L2).

Further, when the web 2 is completely used, as illustrated in FIG. 10, the outer diameter of the feeding roll 2A becomes the minimum and the outer diameter of the winding roll 2B becomes the maximum.

As described above, at least one of the axial core (feeding roller 3) of the feeding roll 2A and the axial core (winding roller 6) of the winding roll 2B is disposed to be relatively movable with respect to the another of the axial core. In this case, the position of the winding roller 6 is fixed, and the feeding roller 3 is disposed to be relatively movable with respect to the winding roller 6.

Here, in a configuration in which the feeding roller 3 and the winding roller 6 do not move relative to each other, the feeding roller 3 and the winding roller 6 has to be disposed at the longest axial-center distance L3 so that the feeding roller 3 and the winding roller assume the relative positions illustrated in FIG. 9B.

Thus, with increase of the length of the web 2 and the maximum outer diameter of the feeding roll 2A, the axial center distance between the feeding roller 3 and the winding roller 6 has to be increased accordingly. Thus, a size of the roll unit and the roll device increases. In order to avoid an increase in the size of the roll unit and the roll device, the outer diameter of the feeding roll 2A has to be restricted. Thus, a frequency of replacing the web 2 is increased.

Conversely, the present embodiment has a configuration in which the feeding roller 3 moves relative to the winding roller 6 so that the axial-center distance L2 can change. Thus, it is possible to dispose the feeding roller 3 and the winding roller 6 at a distance shorter than the longest axial-center distance L3.

As a result, the present embodiment can reduce the size of the wiping cartridge 100 (wiping unit, roll unit) and the wiping device 1 (roll device) while reducing the frequency of replacement of the web 2 (wiping member, roll) by increasing a length of the web 2 and increasing the diameter of the feeding roll 2A.

In the present embodiment, the feeding roller 3 moves relative to the winding roller 6. However, the winding roller 6 may move relative to the feeding roller 3. However, a configuration in which the feeding roller 3 moves relative to the winding roller 6 is simpler since the winding roller 6 is connected to a drive source such as motor and the feeding roller 3 rotates following the winding roller 6.

Figure 11:
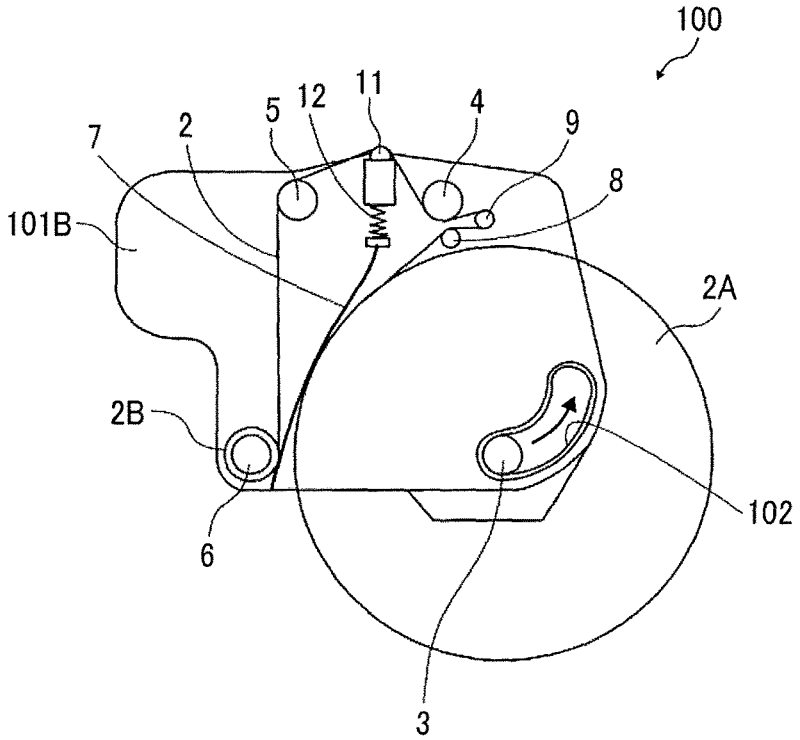
FIG. 11 is an internal side view of a wiping cartridge according to a second embodiment of the present disclosure.
Figure 12:
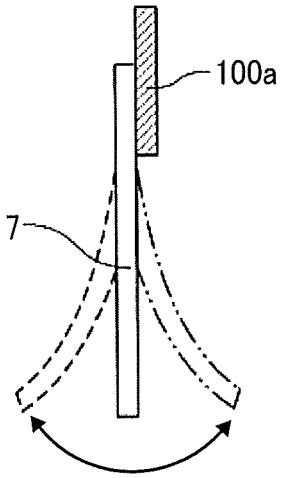
FIG. 12 is a side view of a partition member in the wiping cartridge.

A second embodiment according to the present disclosure is described with reference to FIGS. 11 and 12. FIG. 11 is an internal side view of the wiping cartridge 100 according to the second embodiment. FIG. 12 is a side view of a partition 7 of the wiping cartridge 100.

The second embodiment includes the partition 7 disposed between the feeding roller 3 which is the axial core of the feeding roll 2A and the winding roller 6 which is the axial core of the winding roll 2B. One end of the partition 7 is fixed to the fixing portion 100*a* of the wiping cartridge 100 by adhesion, screwing, locking or the like.

The partition 7 is preferably a deformable and displaceable member having a smooth surface and little friction such as a Mylar sheet. Further, the partition 7 is preferably a member having no water absorbability so that wiped material such as waste liquid does not adhere to the web 2 by the wiping operation.

As illustrated in FIG. 12, the partition 7 can be displaced and deformed from a position indicated by a broken line (left position) to a position indicated by a two-dot chain line (right position) via a position of a solid line (center position), for example, according to a decrease or an increase of a radii of the feeding roll 2A and the winding roll 2B.

As described above, the partition 7 is deformed and displaced according to a decrease in the outer diameter of the feeding roll 2A. Thus, the second embodiment can prevent a peripheral surface of the feeding roll 2A from directly contacting a peripheral surface of the winding roll 2B.

Thus, the second embodiment can prevent slack in a loop of the web caused by an increase in winding load of the winding roller 6 and a difference in circumferential speed between the feeding roller 3 and the winding roller 6 due to direct contact between the circumferential surface of the feeding roll 2A and the circumferential surface of the winding roll 2B.

Next, a wiping cartridge according to a third embodiment of the present disclosure is described with reference to FIGS.

Figure 13A:
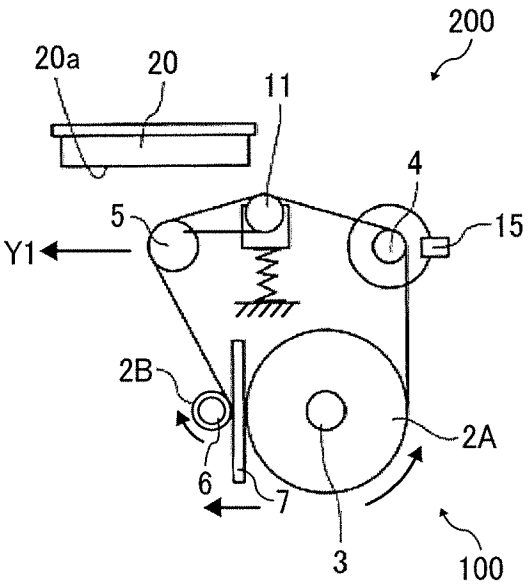
FIGS. 13A through 13C are side views for explaining a wiping cartridge according to a third embodiment of the present disclosure.
Figure 13B:
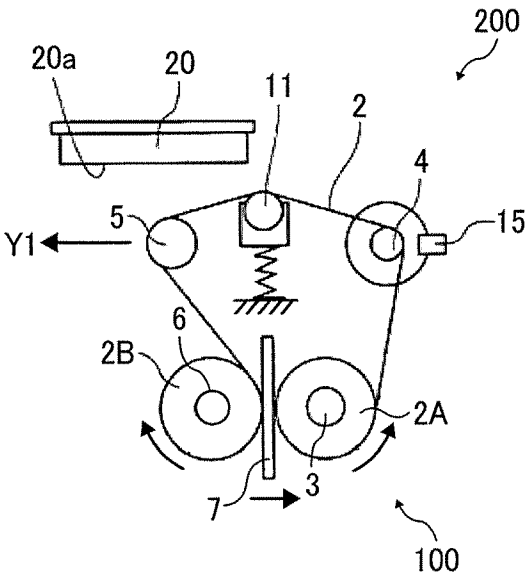
Figure 13C:
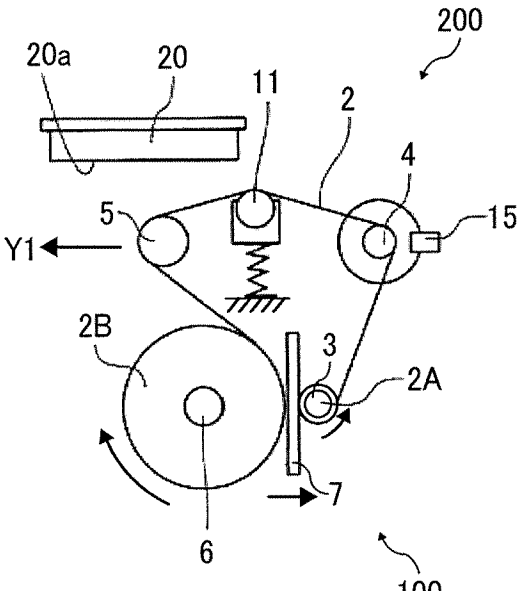
Figure 14:
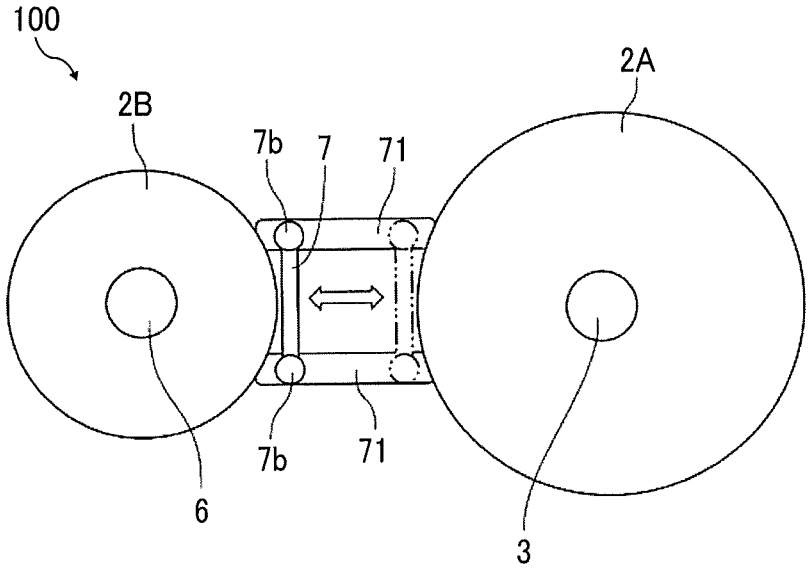
FIG. 14 is a side view of a wiping cartridge for explaining a displacement of the partition member in the wiping cartridge.

13A through 13C and FIG. 14. FIGS. 13A through 13C are side views of the wiping cartridge 100 according to the third embodiment of the present disclosure. FIG. 14 is a side view of the partition 7 in the wiping cartridge 100.

As illustrated in FIG. 14, both end portions 7*b* and 7*b* of the partition 7 are movably supported in the guide grooves 71 in the third embodiment. As a result, the partition 7 is disposed to be linearly movable along the guide groove 71.

Here, as illustrated in FIG. 13A, the partition 7 is arranged close to the winding roll 2B in the initial state. Thus, the partition 7 moves to the feeding roll 2A (feeding roller 3) side as the outer diameter of the winding roll 2B increases as illustrated in FIGS. 13B and 13C.

Thus, the third embodiment can obtain the same operational effect as in the second embodiment.

Figure 15A:
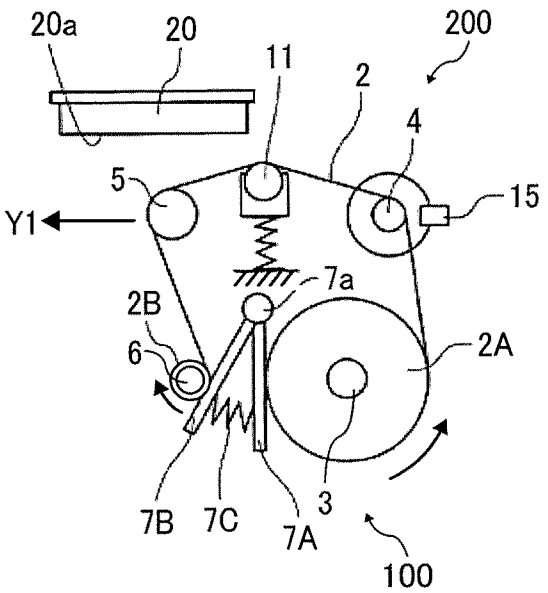
FIGS. 15A through 15C are side views of a wiping cartridge according to a fourth embodiment of the present disclosure.
Figure 15B:
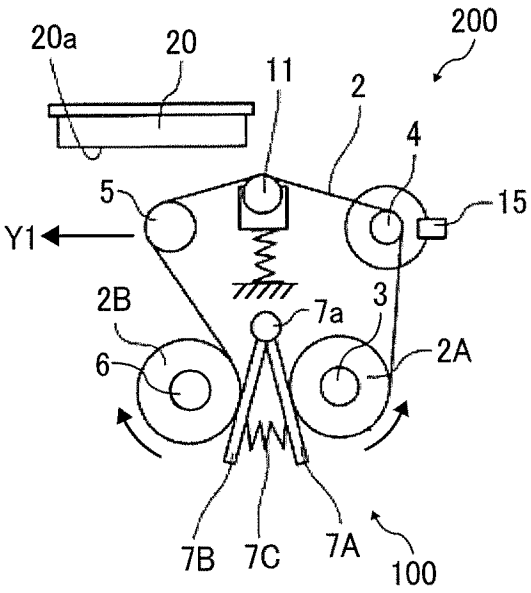
Figure 15C:
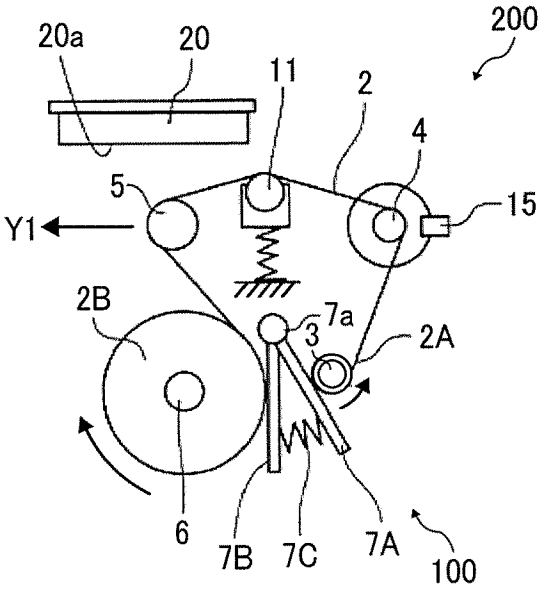

A fourth embodiment according to the present disclosure is described with reference to FIG. 15A through 15C. FIGS. 15A through 15C are side views of a wiping cartridge 100 according to the fourth embodiment.

The wiping cartridge 100 of the fourth embodiment includes two partitions 7A and 7B. Each end of the partitions 7A and 7B is rotatably supported by a support 7*a*. The wiping cartridge 100 includes an urging member 7C (for example, a spring) disposed between the partitions 7A and 7B, for example. The urging member 7C urges the partition 7A so that the partition 7A contacts a peripheral surface of the feeding roll 2A and urges the partition 7B so that the partition 7B contacts a peripheral surface of the winding roll 2B.

Thus, the fourth embodiment can prevent loosening of the feeding roll 2A and the winding roll 2B by bringing the partitions 7A and 7B into contact with the peripheral surface of the feeding roll 2A and the winding roll 2B.

Figure 16C:
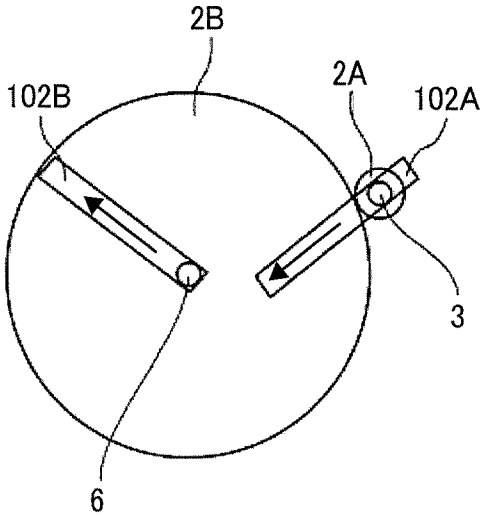
FIGS. 16A through 16C are schematic side views of a wiping cartridge according to a fifth embodiment of the present disclosure.
Figure 16B:
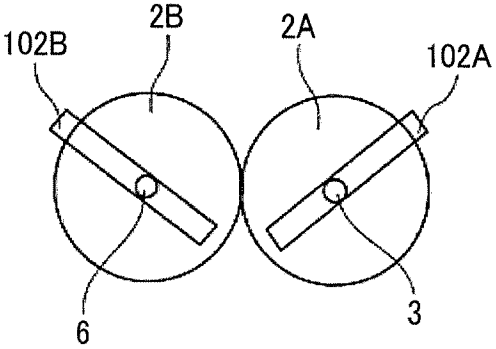
Figure 16A:
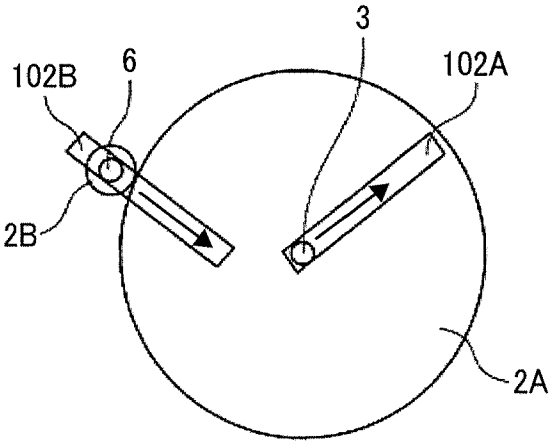

A fifth embodiment according to the present disclosure is described with reference to FIG. 16A through 16C. FIGS. 16A through 16C are schematic side views of a wiping cartridge 100 according to the fifth embodiment.

The wiping cartridge 100 according to the fifth embodiment movably holds the feeding roller 3 as the axial core in the guide groove 102A. Similarly, the wiping cartridge 100 movably holds the winding roller 6 as an axial core in the guide groove 102B. The feeding roller 3 is relatively movable to the winding roller 6.

The guide groove 102A is formed such that the feeding roller 3 as the axial core can move in a direction obliquely upward as indicated by arrow in FIG. 16A. Similarly, the guide groove 102B is formed such that the winding roller 6 can move in a direction obliquely downward as indicated by arrow in FIG. 16A.

With the configuration illustrated in FIG. 16A, the feeding roller 3 is located near a lower part of the guide groove 102A, and the winding roller 6 of the winding roll 2B pushed up by the feeding roll 2A is located near an upper part of the guide groove 102B.

By repeating the wiping operation as illustrated in FIG. 16B, all the web 2 is wound onto the winding roll 2B as illustrated in FIG. 16C through a state in which the outer diameter of the feeding roll 2A and the outer diameter of the winding roll 2B becomes the same. Thus, as illustrated in FIG. 16C, the winding roller 6 is positioned near the lower part of the guide groove 102B, and the feeding roller 3 is positioned near the upper part of the guide groove 102A.

As described above, the feeding roller 3 and the winding roller 6, which are two axial cores, are relatively movable with each other. Thus, the fifth embodiment can save space as compared with the first embodiment.

Figure 17:
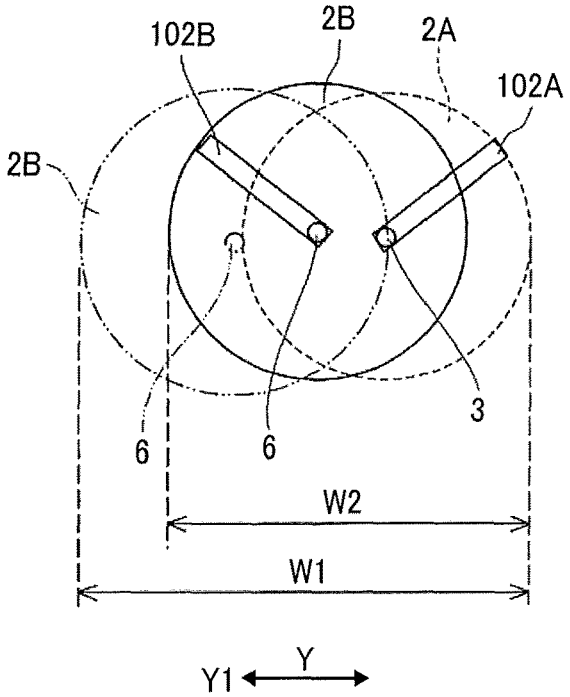
FIG. 17 is a side view of the wiping cartridge comparing the first embodiment and the present embodiment for explaining an operation and effect of the present disclosure.

The operational effect of the present embodiments is described with reference to FIG. 17. FIG. 17 is a side view of a wiping cartridge 100 that compares the first embodiment and the fifth embodiment for explaining the operational effect. FIG. 17 illustrates an initial state of the feeding roll 2A indicated by a broken line in FIG. 17.

In the first embodiment, the winding roller 6 of the wiping cartridge 100 does not move to or move away from the feeding roller 3. In other words, a position of the winding roller 6 is fixed in the first embodiment as illustrated in FIG. 6. Thus, a space in a state in which the outer diameter of the winding roll 2B of the wiping cartridge 100 becomes the maximum has to be secured as indicated by imaginary line (two-dot chain line) in FIG. 17. A width of a space in a moving direction Y of the wiping cartridge 100 is at least a width W1.

Conversely, each of the feeding roller 3 and the winding roller 6 of the wiping cartridge 100 move relative to each other in this fifth embodiment. Thus, as indicated by the solid line in FIG. 17, an amount of swelling of the winding roll 2B in a wiping direction Y1 when outer diameter of the winding roll 2B becomes the maximum is smaller than an amount of swelling in the first embodiment. A width of a space in a moving direction Y of the wiping cartridge 100 is at least a width W2 ($W2<W1$).

Figure 18:
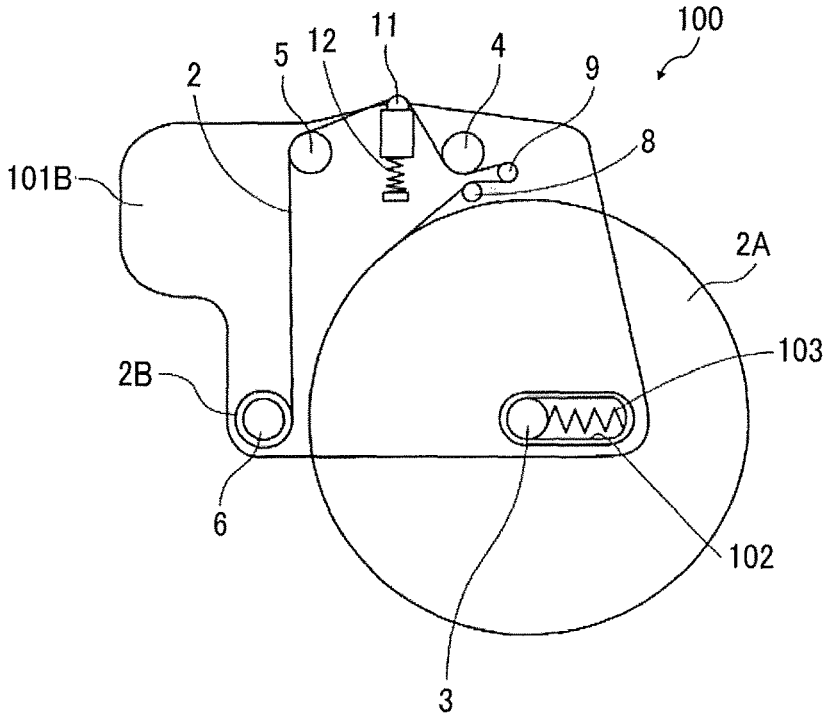
FIG. 18 is an internal side view of a wiping cartridge according to a sixth embodiment of the present disclosure.

A sixth embodiment according to the present disclosure is described with reference to FIG. 18. FIG. 18 is an internal side view of the wiping cartridge 100 according to the sixth embodiment.

In the present embodiment, the guide grooves 102 for guiding the feeding roller 3 is arranged in a horizontal direction. Thus, the feeding roller 3 as the first axial core is movable in the horizontal direction.

The wiping cartridge 100 includes an urging member 103 for urging the feeding roller 3 as one of the axial core in a direction approaching the winding roller 6 as another of the axial core. The urging member 103 urges the feeding roller 3 toward the winding roller 6 with the urging force that allows the feeding roller 3 to be moved in the horizontal direction when the feeding roll 2A is pressed by the winding roll 2B.

Even in such a configuration, the feeding roll 2A can be pushed by the winding roll 2B that cause the feeding roller 3 to move in a direction away from the winding roller 6. Thus, the sixth embodiment can arrange an axial-center distance L1 between the feeding roller 3 and the winding roller 6 to be shorter than the longest axial-center distance L3.

Thus, as in the first embodiment, the sixth embodiment can increase the outer diameter of the feeding roll 2A due to lengthening of the web 2 to reduce the frequency of replacing the web 2 (wiping member, roll). Thus, the sixth embodiment can reduce the size of the wiping cartridge 100 (wiping unit, roll unit) and the wiping device 1 (roll device).

Figure 19:
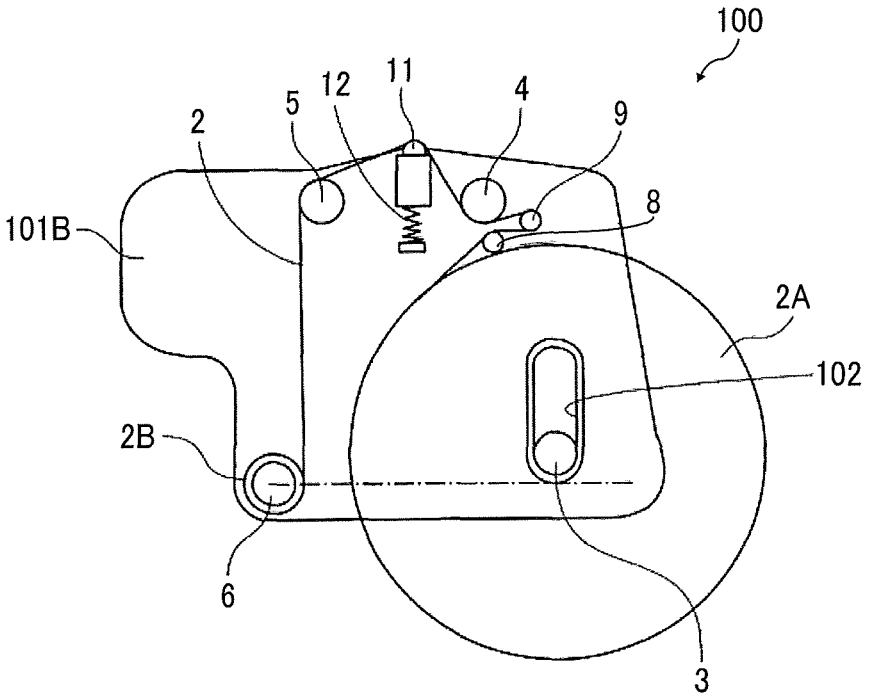
FIG. 19 is an internal side view of a wiping cartridge according to a seventh embodiment of the present disclosure.

A seventh embodiment according to the present disclosure is described with reference to FIG. 19. FIG. 19 is an internal side view of a wiping cartridge 100 according to the seventh embodiment.

In the seventh embodiment, a longitudinal direction of the guide grooves 102 for guiding the feeding roller 3 are arranged along a vertical direction. Thus, the feeding roller 3 that is one of the axial core is arranged to be movable in the vertical direction.

Here, the lowest position of the feeding roller 3 as one of the axial core is disposed higher than an axial center of the winding roller 6 as another of the axial core. The lowest position of the feeding roller 3 is a lower end portion of the guide groove 102.

Even with a configuration in FIG. 19, the feeding roll 2A is pushed by the winding roll 2B, and the feeding roller 3 can move upward away from the winding roller 6. Thus, the sixth embodiment can arrange an axial-center distance L1 between the feeding roller 3 and the winding roller 6 to be shorter than the longest axial-center distance L3.

Thus, as in the first embodiment, the sixth embodiment can increase the outer diameter of the feeding roll 2A due to lengthening of the web 2 to reduce the frequency of replacing the web 2 (wiping member, roll). Thus, the sixth embodiment can reduce the size of the wiping cartridge 100 (wiping unit, roll unit) and the wiping device 1 (roll device).

Figure 20:
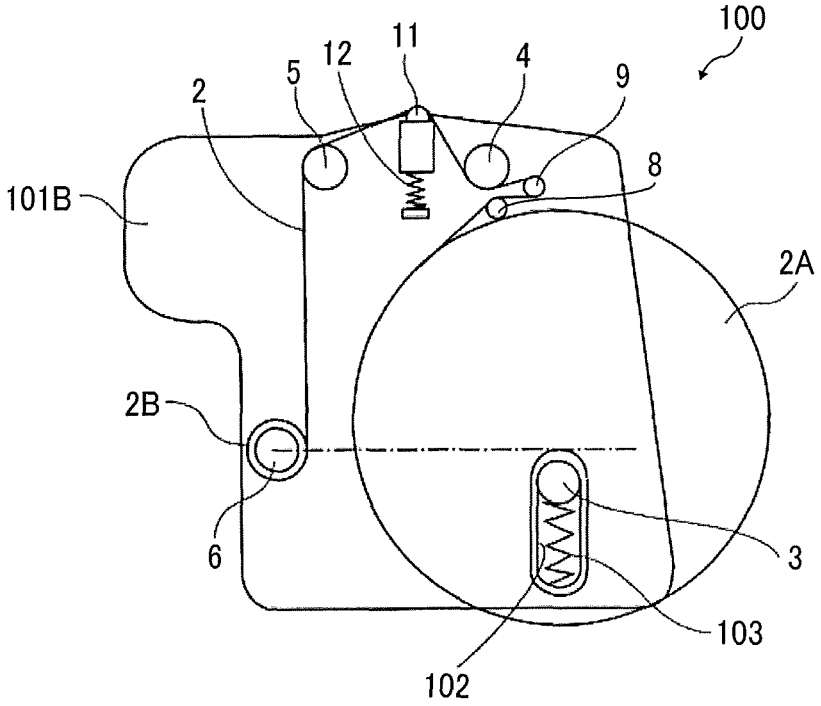
FIG. 20 is an internal side view of a wiping cartridge according to an eighth embodiment of the present disclosure.

FIG. 20 is a side view of the wiping cartridge 100 according to an eighth embodiment of the present disclosure. FIG. 20 is an internal side view of the wiping cartridge 100 according to the eighth embodiment.

In the seventh embodiment, a longitudinal direction of the guide grooves 102 for guiding the feeding roller 3 are arranged along a vertical direction. Thus, the feeding roller 3 that is one of the axial core is arranged to be movable in the vertical direction. The highest position of the feeding roller 3 as one of the axial core is disposed lower than an axial center of the winding roller 6 as another of the axial core. The highest position of the feeding roller 3 is an upper end portion of the guide groove 102.

Further, the wiping cartridge 100 includes an urging member 103 that urges the feeding roller 3 in an upward direction. The urging member 103 pushes up the feeding roller 3 to the upper end of the guide groove 102 in the initial state. The urging member 103 urges the feeding roller 3 upward with an urging force that allows the feeding roller 3 to be moved to a lower direction when the feeding roll 2A is pressed by the winding roll 2B.

Even with a configuration in FIG. 20, the feeding roll 2A can be pushed by the winding roll 2B that cause the feeding roller 3 to move in a lower direction away from the winding roller 6. Thus, the sixth embodiment can arrange an axial-center distance L1 between the feeding roller 3 and the winding roller 6 to be shorter than the longest axial-center di stance L3.

Thus, as in the first embodiment, the seventh embodiment can increase the outer diameter of the feeding roll 2A due to lengthening of the web 2 to reduce the frequency of replacing the web 2 (wiping member, roll). Thus, the eighth embodiment can reduce the size of the wiping cartridge 100 (wiping unit, roll unit) and the wiping device 1 (roll device).

Figure 21:
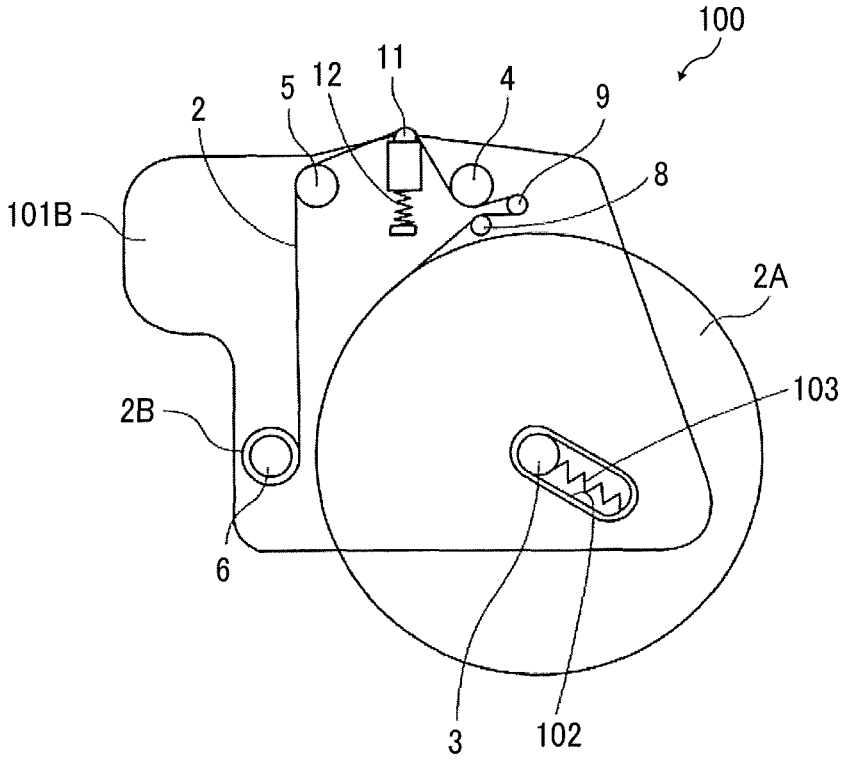
FIG. 21 is an internal side view of a wiping cartridge according to a ninth embodiment of the present disclosure.

A ninth embodiment according to the present disclosure is described with reference to FIG. 21. FIG. 21 is an internal side view of the wiping cartridge 100 according to the ninth embodiment.

In the ninth embodiment, a longitudinal direction of the guide groove 102 for guiding the feeding roller 3 is arranged obliquely downward. Thus, the feeding roller 3 that is one of the axial core is arranged to be movable in an obliquely downward direction.

Further, the wiping cartridge 100 includes the urging member 103 that urges the feeding roller 3 in an obliquely upward direction. The urging member 103 pushes up the feeding roller 3 to the upper end of the guide groove 102 in the initial state. The urging member 103 urges the feeding roller 3 in an obliquely upward direction with an urging force that allows the feeding roller 3 to be moved to an obliquely lower direction when the feeding roll 2A is pressed by the winding roll 2B.

Even with a configuration in FIG. 21, the feeding roll 2A can be pushed by the winding roll 2B that cause the feeding roller 3 to move in the obliquely lower direction away from the winding roller 6. Thus, the sixth embodiment can arrange an axial-center distance L1 between the feeding roller 3 and the winding roller 6 to be shorter than the longest axial-center distance L3.

Thus, as in the first embodiment, the seventh embodiment can increase the outer diameter of the feeding roll 2A due to lengthening of the web 2 to reduce the frequency of replacing the web 2 (wiping member, roll). Thus, the eighth embodiment can reduce the size of the wiping cartridge 100 (wiping unit, roll unit) and the wiping device 1 (roll device).

Figure 22:
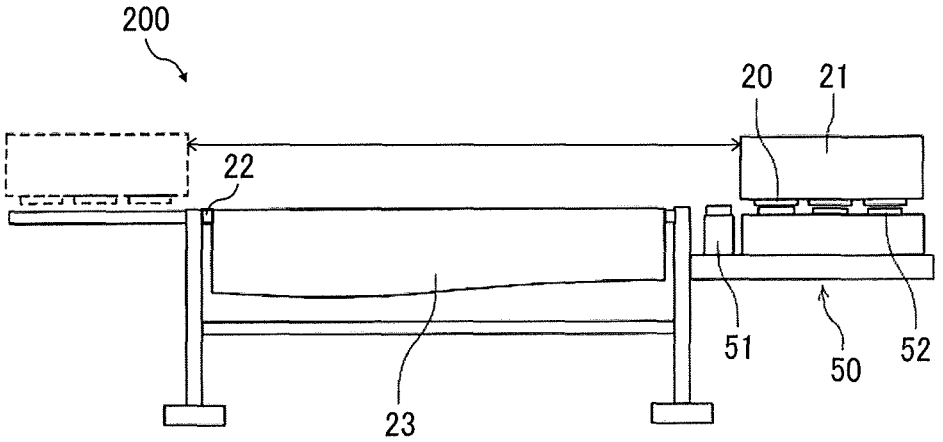
FIG. 22 is a front view of a liquid discharge apparatus including a head maintenance device according to the present disclosure.

FIGS. 22 and 23 illustrate a liquid discharge apparatus 200 including a head maintenance device according to the present disclosure. FIG. 22 is a front view of the liquid discharge apparatus 200. FIG. 23 is a plan view of a carriage 21 of the liquid discharge apparatus 200 in FIG. 22.

The liquid discharge apparatus 200 is a serial type apparatus in which one or a plurality of heads 20A through 20C (see FIG. 23) are mounted on a carriage 21. The liquid discharge apparatus 200 includes a conveyer 22 to intermittently convey a medium 23. Then, the carriage 21 is reciprocally moved in the direction indicated by arrow in FIG. 22, and the heads 20 discharge required color or amount of liquid onto the medium 23 to form an image on the medium 23.

Further, the liquid discharge apparatus 200 includes a head maintenance device 50 that includes caps 52 for capping the nozzle surface 20*a* of the heads 20 on a home position side (right side in FIG. 22) of the carriage 21 and a head maintenance device 51 including the wiping device 1 (head cleaning device) as described in the first to fifth embodiments that cleans and maintains the head 20. The head maintenance device 51 may further include a wiper blade to wipe the nozzle surface 20*a* of the heads 20.

The liquid discharge apparatus 200 includes the head maintenance device 50 that includes the wiping device 1 according to the present disclosure as described above. Thus, the liquid discharge apparatus 200 can clean the nozzle surface 20*a* and perform stable liquid discharge. Further, the liquid discharge apparatus 200 can reduce the size of the apparatus.

In the above embodiment, the wiping cartridge 100 as a roll unit using a wiping member such as the web 2 as the belt-shaped member, the wiping device 1 as the roll device, the head maintenance device 50, and the liquid discharge apparatus 200 are described. The belt-shaped member is not limited to the web 2 (wiping member). For example, the belt-shaped member may be a roll unit, a roll device, etc. of roll paper.

In other words, an object to be wound onto the feeding roll 2A and the winding roll 2B is not limited only to the web 2. The present disclosure may be applied to any object as long as the object is generally wound in a roll shape (belt-shaped member) such as roll paper, label, tape, fabric for clothing, and the like.

Also, the thickness and material of the belt-shaped member are not limited. A conveyance (creeping) route of the belt-shaped member and the arrangement of the roll can be appropriately changed according to the use of the roll unit and the roll device.

In consideration of the ease of moving the roll, the present discourse is particularly effective for a product in which the total weight of the belt-shaped member wound as the feeding roll 2A is small.

In the present disclosure, the discharged liquid is not limited to a particular liquid as long as the liquid has a viscosity or surface tension that allows the liquid to be discharged from a head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent such as water and an organic solvent, a colorant such as dye and pigment, a functional material such as a polymerizable compound, a resin, and a surfactant, a biocompatible material such as deoxyribonucleic acid (DNA), amino acid, protein, and calcium, or an edible material such as a natural colorant.

Such a solution, a suspension, and an emulsion are used for, e.g., inkjet ink, a surface treatment solution, a liquid for forming components of an electronic element and a light-emitting element or a resist pattern of an electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The "liquid discharge device" is an integrated unit including the head and a functional part(s) or unit(s), and is an assembly of parts relating to liquid discharge. For example, "the liquid discharge device" may be a combination of the head with at least one of a head tank, a carriage, a supply unit, a maintenance unit, and a main scan moving unit.

Herein, the terms "integrated" or "united" mean fixing the head and the functional parts (or mechanism) to each other by fastening, screwing, binding, or engaging and holding one of the head and the functional parts movably relative to the other. The head may be detachably attached to the functional part(s) or unit(s) each other.

For example, the head and a head tank are integrated as the liquid discharge device. The head and the head tank may be connected each other via, e.g., a tube to integrally form the liquid discharge device. Here, a unit including a filter may further be added to a portion between the head tank and the head of the liquid discharge device.

The liquid discharge device may be an integrated unit in which a head is integrated with a carriage.

The liquid discharge device may be the head movably held by a guide that forms part of a main scan moving unit, so that the head and the main scan moving unit are integrated as a single unit. The liquid discharge device may include the head, the carriage, and the main scan moving unit that are integrated as a single unit.

In another example, the cap that forms a part of the maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit. Liquid is supplied from a liquid reservoir source such as liquid cartridge to the head through the tube.

The main scan moving unit may be a guide only. The supply unit may be a tube(s) only or a mount part (loading unit) only.

The term "liquid discharge apparatus" used herein also represents an apparatus including the head or the liquid discharge device to discharge liquid by driving the head. The liquid discharge apparatus may be, for example, an apparatus capable of discharging liquid onto a material to which liquid can adhere or an apparatus to discharge liquid into gas or another liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A head maintenance device to maintain a liquid discharge head to discharge a liquid from nozzles, the head maintenance device comprising:

a roll device, the roll device comprising:

a roll unit comprising:

a feeding roller to which a belt-shaped member is wound; and a winding roller to which the belt-shaped member fed from the feeding roller is wound, one of the feeding roller and the winding roller being relatively movable to the other of the feeding roller and the winding roller, and being movably held in the roll unit, the feeding roller and the winding roller being arranged such that, as the belt-shaped member is wound, the one of the feeding roller and the winding roller is moved depending on a diameter of a roll composed of the other of the feeding roller and the winding roller and of a portion of the belt-shaped member wound on the other of the feeding roller and the winding roller, wherein the belt-shaped member is a wiping member to perform wiping, and wherein the roll unit is operative to wipe a surface of the liquid discharge head on which the nozzles are formed with the wiping member.

2. The head maintenance device according to claim 1, wherein the one of the feeding roller and the winding roller is relatively movable in an obliquely upward direction away from the other of the feeding roller and the winding roller.

3. The head maintenance device according to claim 1, wherein the one of the feeding roller and the winding roller is movable in a horizontal direction, and the roll unit further comprising an urging member to push the one of the feeding roller and the winding roller close to other of the feeding roller and the winding roller.

4. The head maintenance device according to claim 1, wherein the one of the feeding roller and the winding roller is movable in a vertical direction, and a lowest position of the one of the feeding roller and the winding roller is disposed higher than the other of the feeding roller and the winding roller.

5. The head maintenance device according to claim 1, wherein the one of the feeding roller and the winding roller is movable in a vertical direction, a highest position of the one of the feeding roller and the winding roller is disposed lower than the other of the feeding roller and the winding roller, and the roll unit further comprising an urging member to push the one of the feeding roller and the winding roller upward.

6. The head maintenance device according to claim 1, wherein the one of the feeding roller and the winding roller is movable in an obliquely downward direction away from the other of the feeding roller and the winding roller, and the roll unit further comprising an urging member to push the one of the feeding roller and the winding roller obliquely upward.

7. The head maintenance device according to claim 1, further comprising a partition movably disposed between the feeding roller and the winding roller.

8. The head maintenance device according to claim 1, wherein the belt-shaped member is a wiping member to perform wiping.

9. The head maintenance device according to claim 1, wherein the roll device further comprises a movable platform detachably mounting the roll unit to move the roll unit.

10. A liquid discharge apparatus comprising:

the liquid discharge head to discharge the liquid from the nozzles; and the head maintenance device according to claim 1.

11. The head maintenance device according to claim 1, further comprising a partition disposed between the feeding roller and the winding roller, wherein the partition is displaced and deformed according to a decrease or an increase in an outer diameter of a feeding roll formed by the belt-shaped member wound around the feeding roller and a winding roll formed by the belt-shaped member wound around the winding roller.

12. The head maintenance device according to claim 1, wherein the one of the feeding roller and the winding roller is relatively movable to the other of the feeding roller and the winding roller such that a distance between an axial center of the feeding roller and an axial center of the feeding roller can change.

13. The head maintenance device according to claim 1, further comprising:

a feeding roll formed by the belt-shaped member wound around the feeding roller; and a winding roll formed by the belt-shaped member wound around the winding roller, wherein, in an initial state, an outer diameter of the feeding roll is a maximum, and a distance between an axial center of the feeding roller and an axial center of the winding roller is a minimum axial-center distance, wherein, during winding of the belt-shaped member on to the winding roller, an outer periphery of the winding roll contacts an outer periphery of the feeding roll, and the distance between the axial center of the feeding roller and the axial center of the winding roller varies and is greater than the minimum axial-center distance, and wherein the distance between the axial center of the feeding roller and the axial center of the winding roller is a maximum axial-center distance when an outer diameter of the winding roll is equal to the outer diameter of the feeding roll.

14. The head maintenance device according to claim 13, wherein the belt-shaped member is fed from the feeding roller to the winding roller via a guide roller, and a pair of conveyance rollers.

15. The head maintenance device according to claim 14, wherein a pressing member which presses the belt-shaped member against an object to be wiped is disposed between the pair of conveyance rollers.

* * * * *